US010995575B2

(12) United States Patent
Hejleh

(10) Patent No.: US 10,995,575 B2
(45) Date of Patent: May 4, 2021

(54) DOWNHOLE SURVEYING AND CORE SAMPLE ORIENTATION SYSTEMS, DEVICES AND METHODS

(71) Applicant: Globaltech Corporation Pty Ltd, Forrestfield (AU)

(72) Inventor: Khaled Mufid Yousef Hejleh, Peppermint Grove (AU)

(73) Assignee: Globaltech Corporation Pty Ltd, Forrestfield (AU)

( * ) Notice: Subject to any disclaimer, the term of this patent is extended or adjusted under 35 U.S.C. 154(b) by 309 days.

(21) Appl. No.: 16/077,483

(22) PCT Filed: Feb. 16, 2017

(86) PCT No.: PCT/AU2017/050137
§ 371 (c)(1),
(2) Date: Aug. 13, 2018

(87) PCT Pub. No.: WO2017/139847
PCT Pub. Date: Aug. 24, 2017

(65) Prior Publication Data

US 2019/0071944 A1 Mar. 7, 2019

(30) Foreign Application Priority Data

Feb. 15, 2016 (AU) ..... 2016900518

(51) Int. Cl.
*E21B 25/16* (2006.01)
*E21B 25/02* (2006.01)
*E21B 31/18* (2006.01)

(52) U.S. Cl.
CPC ..... *E21B 25/16* (2013.01); *E21B 25/02* (2013.01); *E21B 31/18* (2013.01)

(58) Field of Classification Search
CPC ..... E21B 25/16; E21B 25/02
(Continued)

(56) References Cited

U.S. PATENT DOCUMENTS

2005/0132794 A1* 6/2005 Spross ..... G01V 11/00 73/152.03
2007/0282533 A1* 12/2007 Parfitt ..... E21B 47/026 702/2

(Continued)

FOREIGN PATENT DOCUMENTS

AU 200810102 A4 11/2008
AU 2008230012 B2 6/2015

(Continued)

*Primary Examiner* — Ricky Ngon
*Assistant Examiner* — Ricky Go
(74) *Attorney, Agent, or Firm* — Charles H. Jew

(57) ABSTRACT

A method and system for obtaining orientation of a core sample core drilled from underlying rock. A core orientation recording device (116) records its orientation at random and/or non-predetermined time intervals from a reference time during a drilling operation. The time intervals are generated to be within a range of minimum and maximum time intervals. After a time interval elapsed from the reference time plus a wait time of at least the minimum random or non-predetermined time interval, the core sample is separated from the underlying rock and brought to the surface and its original orientation is determined from orientation data recorded closest in time to the elapsed time plus the minimum time interval. A remote communicator (160) having the elapsed time interrogates the core orientation recordal device (116) to identify the required orientation data and requires the core orientation recordal device to identify a correct orientation of the core sample.

15 Claims, 3 Drawing Sheets

(58) Field of Classification Search
USPC ..... 702/9
See application file for complete search history.

(56) References Cited

U.S. PATENT DOCUMENTS

| | | | | |
|---|---|---|---|---|
| 2012/0037421 | A1* | 2/2012 | Parfitt | E21B 25/16 175/44 |
| 2015/0136488 | A1* | 5/2015 | Hejleh | E21B 25/16 175/44 |
| 2015/0300162 | A1* | 10/2015 | Drenth | E21B 25/16 175/44 |

FOREIGN PATENT DOCUMENTS

| | | | |
|---|---|---|---|
| WO | 2007/137356 | A1 | 12/2007 |
| WO | 2013/126955 | A1 | 9/2013 |
| WO | 2015/164394 | A1 | 10/2015 |
| WO | 2016/154677 | A1 | 10/2016 |

* cited by examiner

DOWNHOLE SURVEYING AND CORE SAMPLE ORIENTATION SYSTEMS, DEVICES AND METHODS

FIELD OF THE INVENTION

The present invention relates to improvements to systems, devices and methods for conducting downhole surveying and/or for use in determining the orientation of a core sample relative to a body of material from which the core sample is obtained.

BACKGROUND TO THE INVENTION

Core orientation is the process of obtaining and marking the orientation of a core sample from a drilling operation.

The orientation of the sample is determined with regard to its original position in a body of material, such as rock or ore deposits underground.

Core orientation is recorded during drilling, and analysis is undertaken during core logging. The core logging process requires the use of systems to measure the angles of the geological features, such as an integrated core logging system.

Whilst depth and azimuth are used as important indicators of core position, they are generally inadequate on their own to determine the original position and attitude of subsurface geological features.

Core orientation i.e. which side of the core was facing the bottom (or top) of a borehole and rotational orientation compared to surrounding material, enables such details to be determined.

Through core orientation, it is possible to understand the geology of a subsurface region and from that make strategic decisions on future mining or drilling operations, such as economic feasibility, predicted ore body volume, and layout planning.

In the construction industry, core orientation can reveal geological features that may affect siting or structural foundations for buildings.

Core samples are cylindrical in shape, typically around 3 metres long, and are obtained by drilling with an annular hollow core drill into subsurface material, such as sediment and rock, and recoverying the core sample.

A diamond tipped drill bit is often used and is fitted at the end of the hollow drill string. As the drill bit progresses deeper, more sections of hollow steel drill tube are added to extend the drill string.

An inner tube assembly captures the core sample. This inner tube assembly remains stationary while the outer tubes rotate with the drill bit. Thus, the core sample is pushed into the inner tube.

A 'back end' assembly connects to a greaser. This greater lubricates the back end assembly which rotates with the outer casing while the greater remains stationary with the inner tubing.

Once a core sample is cut, the inner tube assembly is recovered by winching to the surface. After removal of the back end assembly from the inner tube assembly, the core sample is recovered and catalogued for analysis.

Various core orientation systems have previously been used or proposed. For example, early systems use a spear and clay impression arrangement. A spear is thrown down the drill string and makes an impression in clay material at an upper end of the core sample. This impression can be used to vindicate the orientation of the core at the time and position the spear impacted the clay.

A more recent system of determining core orientation is proposed in Australian patent number AU 2010200162. This patent describes a system requiring a device at the surface and a separate downhole core orientation tool. Each of the device and downhole tool has a timer. Both timers are started at a reference time. The downhole tool records measurements relating to orientation of the tool at regular predetermined time intervals.

According to AU 2010200162, a 'mark' is taken when drilling is ceased and the core sample is ready to be separated from the underlying rock. This 'mark' is recorded by the device at the surface as a specific time from the reference time. The core sample is then separated from the rock and the downhole tool is returned to the surface with core sample in an attached core tube. The device retained at the surface then interrogates the returned downhole tool to identify the measured orientation data that was recorded closest to the end of the specific time i.e. presumably when drilling was ceased and the core sample and downhole tool have not rotated relative to one another prior to breaking the core sample from the rock.

Thus, AU 2010200162 looks forward in time the specific amount of time from the reference time commenced at the surface. Both timers, the one at the surface and the one downhole, have to count time at exactly the same rate from the commenced reference time i.e. the two timers are synchronised.

Furthermore, the downhole tool takes measurements at regular predetermined intervals, many measured values being unusable because they are recorded whilst drilling is underway, resulting in there being no reliable rotational position relationship between the downhole tool and the core sample being drilled, since vibration from drilling causes variation in their rotational relationship and therefore discrepancies between measurements.

In addition, because AU 2010200162 takes measurements at predetermined regular time intervals, on-board battery power is wasted obtaining unusable measurements.

Thus, AU 2010200162 takes measurements determined by an on-board timer whether or not the values obtained are worthwhile or accurate. This leads a large amount of unusable data which is typically discarded and such continuous or too often recording of data unnecessarily rapidly reduces battery life of the downhole device. Such known arrangements may only last a few weeks or months before the downhole device needs recharging or replacing. Often spare equipment is held on hand just in case the batter fails. This leads to far too much equipment being needed, at an increased cost to the drilling operator. It would be beneficial to reduce reliance on holding spare equipment on hand.

In addition, it has been realised that, during the drilling process, if sections of fragmented earth are drilled into (resulting in fractured core samples) then the inner tube can rotate. Furthermore, vibrations caused by drilling have also been identified as a cause of inaccurate data.

Also, it has been realised that only a limited amount of downhole data is actually required in order to later determine correct orientation of a core sample at the surface.

It has been realised that data recording on a continuous or frequent periodic basis whilst drilling is occurring is unnecessary. Only down orientation of the core sample needs to be known, and provided data relating to the down orientation can be identified and referenced to a particular known time, core orientation can be determined.

Another downhole tool is described in Australian patent number AU2008229644, which tool requires a downhole event to be detected by a trigger system so that the trigger system consequently triggers the tool to record a position measurement. The trigger system has to detect a downhole event before the tool will record the position indication.

Some core orientation systems utilise a timer at the surface synchronised with a timer in the downhole tool. The timer at the surface is typically in a handheld device, and both timers (the one in the handheld device to remain at the surface and the one in the tool to go downhole) are started together. This creates a reference time. The tool takes measurements of its own rotational orientation about a longitudinal axis at predetermined time intervals. Once drilling has ceased and the operator is ready to break a rock core sample from the underlying rock downhole, the operator at the surface marks a time beyond the reference time relevant to which the core is broken. The tool and core sample are retrieved to the surface. The measurement taken at the time beyond the reference time is identified (this being a number of measurements subsequent to commencing taking measurements at the predetermined time intervals. Taking unnecessary measurements at predetermined time intervals during descent of the tool downhole is not practically useful and wastes battery power.

It is also been found to be unnecessary to limit the tool to taking measurements at predetermined time intervals as utilised by Australian patent AU2010200162. Provided the correct measurement data set can be identified that was recorded while drilling had stopped and immediately before breaking the core sample from the underlying rock, it has been realised that the time intervals for recording measurements have been found to be irrelevant.

It has therefore been found desirable to provide improved downhole core orientation system, device or method that avoids or at least alleviates at least one of the aforementioned limitations.

SUMMARY OF THE INVENTION

An aspect of the present invention provides a method of obtaining an indication of the orientation of a core sample relative to a body of material from which the core sample has been extracted, the method including:

a) drilling a core sample from a body of material with a core drill having an inner tube;
b) recording measurements indicative of the orientation of the inner tube at non-predetermined or random time intervals,
c) the recorded measurements are time stamped and referable to an initial reference time;
d) recording a time beyond the reference time when the drilling has stopped and before the core sample is separated from the body of material;
e) separating the core sample from the body of material and retrieving the inner tube with the core sample held therein to the surface;
f) relating the recorded time beyond the reference time to one or more of the measurements recorded at a said non-predetermined or random time interval to obtain an indication of the orientation of the inner tube and consequently the core contained therein at the time beyond the reference time.

A further aspect of the present invention provides a method of providing an indication of the orientation of a core sample relative to a body of material from which the core sample has been extracted, the method comprising:

a) drilling a core sample from a body of material with a core drill having an inner tube;
b) recording measurements of the orientation of the inner tube at random and non-predetermined time intervals during said drilling;
c) the measurements are time stamped and are referable to an initial reference time;
d) providing a specific time beyond the reference time representative of when the drilling has stopped and before the core sample is separated from the body of material;
e) identifying a said measurement recorded at a non-predetermined time interval indicative of the orientation of the inner tube and consequently the core contained therein at the specific time.

A further aspect of the present invention provides a core orientation system for use with a core drill having an inner tube to receive a core sample drilled from a body of subsurface material, the system including: signal producing means to produce at least one signal relating to a physical orientation of the inner tube, and measurement means to provide a measurement indicative of when the core sample is detached from the body of material from which it is taken and held in fixed relation to the inner tube, the measurement provided at random and/or non-predetermined time intervals; and input means for inputting the measurement into the system; at least one processor for processing the at least one signal to provide data indicative of an orientation of the inner tube; and at least one processing means for processing the provided data and the inputted measurement to produce an indication of the orientation of the core sample relative to the subsurface material from which it has been detached; and display means for the indication of the orientation of the core sample relative to the subsurface material from which it has been detached.

The system may include one or more means for storing the data produced and the indication of the orientation of the core sample.

The data storing means may include a memory. The system may include an interface having first means for storing the data in the memory. Preferably the interface includes a second means for accessing the memory to produce the indication of the orientation of the detached core.

The system may include a timer for providing the random time intervals, preferably relative to a reference time.

Means may be provided for storing the data in the memory at the end of or after elapse of at least one of, preferably each, respective random time interval.

Physical orientation of the core sample may include a rotational orientation about a longitudinal axis of the core sample; and/or an angular orientation of a longitudinal axis of the core sample above or below a horizontal plane.

A further aspect of the present invention provides a method of providing an indication of the orientation of a core sample relative to a body of subsurface material from which the core sample has been extracted, the method comprising: drilling a core sample from a body of material with a core drill having an inner tube; recording orientation of the inner tube at random and/or non-predetermined time intervals subsequent to a reference time; removing the inner tube, with the core sample held therein in fixed relation to it, from the body of subsurface material; and identifying the orientation of the inner tube and core sample based on the orientation recorded at at least one of the random time intervals based on time elapsed subsequent to the reference time.

Preferably, the recording of the orientation of the inner tube is recorded during said drilling.

Preferably, the recording of the orientation of the inner tube is recorded during periods when drilling has ceased.

Preferably, the recording of the orientation of the inner tube is recorded during said drilling. During said drilling may be during actual drilling or during the time from commencement of drilling to separation of the core from the subsurface material.

Preferably, the random time intervals are referable to an initial reference time.

Preferably a specific time is inputted after the reference time and the specific time is representative of when the core sample was separated from the body of subsurface material.

Preferably the inputted specific time is related to the recorded at least one random time interval to obtain an indication of the orientation of the inner tube and consequently the core contained therein at the specific time.

One or more signals indicative of the orientation of the inner tube at any instant in time during said drilling may be provided.

The at least one signal may be processed to determine data indicative of the orientation of the inner tube at various instants in time.

A time measurement may be inputted representative of the instant in time when the core sample was separated from the body of subsurface material in fixed relationship with the inner tube.

The inputted time measurement may be compared to the instants in time and used to identify the data indicative of the orientation of the inner tube and consequently the core sample at the instant in time.

The identified data indicative of the orientation of the inner tube may be displayed once the core sample is returned to the surface.

Data may be generated representative of the orientation of the core sample at a subsequent time and a visual indication may be provided of the orientation of the core sample at a time as which the drilling ceased and/or a direction in which the core sample should be rotated at said subsequent time in order to bring the core sample into an orientation corresponding to its orientation in the identified data.

Preferably the instant in time is representative of a duration of time relative to the reference time.

The data indicative of the orientation of the inner tube may be stored at various instants in time at random time intervals.

Preferably the time measurement includes a time interval, and the time interval is related to one of the random and/or non-predetermined time intervals to identify data indicative of the orientation of the inner tube at the time interval.

Preferably, the method includes obtaining and orientating a core sample, comprising The physical orientation of the core sample may be a rotational orientation about a longitudinal axis of the core sample; and/or an angular orientation of a longitudinal axis of the core sample above or below a horizontal plane.

A tri-axial accelerometer may be used to provide the signals associated with a physical orientation of the core sample.

A further aspect of the present invention provides a core orientation system for providing an indication of the orientation of a core sample relative to a body of material from which the core sample has been extracted using a core drill, the core drill having an inner tube, the system including: means for recording the orientation of the inner tube at non-predetermined and/or random time intervals during drilling by the core drill, the time intervals being referable to an initial reference time, and for inputting the specific time beyond the reference time representative of when the core sample was separated from the body of material; and means for relating the inputted specific time to the recorded time intervals to obtain an indication of the orientation of the inner tube and consequently the core contained therein at the specific time.

The system may include means for providing signals associated with the physical orientation of the inner tube of the core drill during drilling; input means for inputting into the system a time measurement indicative of the time during drilling when the core sample is detached from the body of material from which it is taken and held in fixed relation to the inner tube; one or more processing means for processing the signals to produce data indicative of the orientation of the inner tube; one or more processing means for processing the data produced and the inputted time measurement to produce an indication of the orientation of the core sample relative to the material from which it is detached; and display means for the indication of the orientation of the core sample relative to the material from which it is detached.

The system may include one or more means for storing the data produced and/or the indication of the orientation of the core sample.

The means for storing the data may include a memory, the system comprising interface means having first means for storing the data in the memory and second means for accessing the memory to produce the indication of the orientation of the core sample when detached when required.

Non-predetermined time intervals or random time intervals means that the orientation measurements are taken at time periods that are not known. These can be irregular time intervals or random time intervals.

A random number generator can be used to generate the non-predetermined time intervals.

The non-predetermined time intervals can be within a known range between a minimum and a maximum time interval. However, the exact intervals used within that range are not prior known.

BRIEF DESCRIPTION OF THE DRAWINGS

FIG. 4 shows an extension piece connected inline between two adjacent tubes in order to compensate the length of the outer drilling tube in relation to the additional length gained by the inner tube assembly due to an instrument, such as a core sample orientation data gathering device.

DESCRIPTION OF PREFERRED EMBODIMENT

Figure 1:
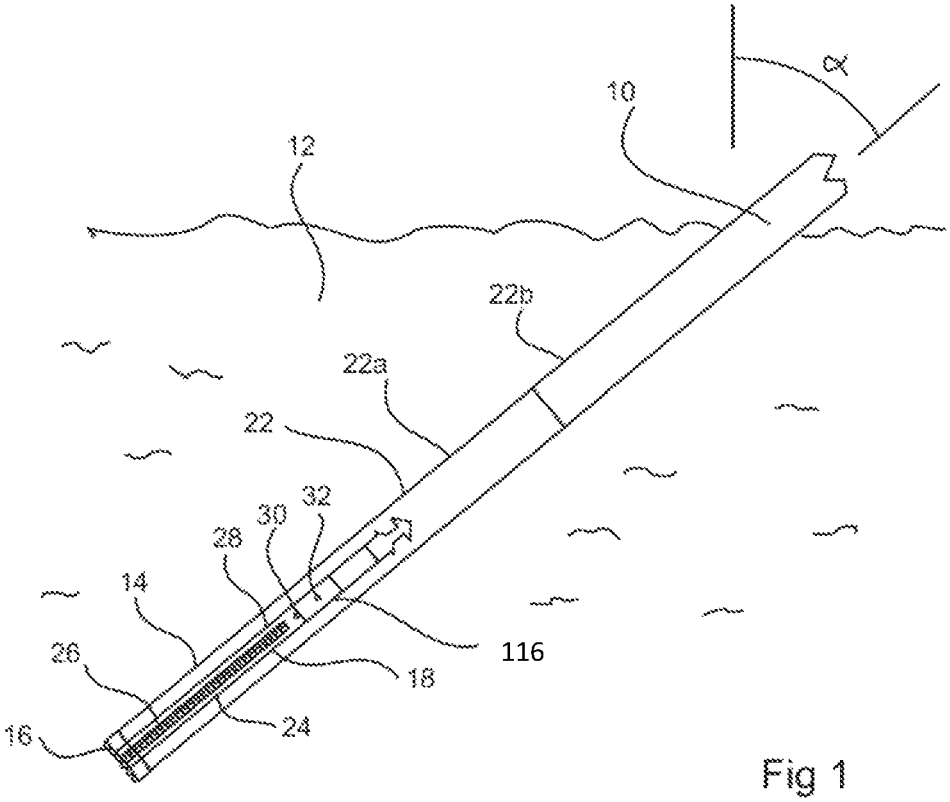
FIG. 1 shows a general arrangement of a drill assembly for obtaining core sample according to an embodiment of the present invention.

With reference to FIG. 1, a drill assembly 10 is provided for drilling into a subsurface body of material 12 which includes a drillstring 14 including a drill bit 16 an out tube 22 formed of linearly connected tube sections 22*a*, 22*b* . . .

, and an inner tube assembly 18 including an inner tube 24 for receiving the core 26 drilled from the subsurface body.

One or more pressure sensors 28, 30, 32 can be provided to detect pressure, change in pressure and/or pressure differential. These can communicate with the core orientation data recording device 116 and/or an operator at the surface.

Drilling can cease and the core orientation device 116 can record data relating to the orientation of the core, such as gravitational field strength, gravitational field direction, magnetic field strength and/or magnetic field direction.

Digital and/or electro-mechanical sensors, and/or one or more pressure sensors in a core orientation data recording device 116, are used to determine the core orientation just prior to the core break, and to detect the signal of the break of the core from the body of material.

Data recorded or used may optionally include 'dip' angle $\alpha$ to increase reliability of core orientation results.

Dip (also referred to as inclination or declination) is the angle of the inner core tube drill assembly with respect to the horizontal plane and can be the angle above or below the horizontal plane depending on drilling direction from above ground level or from underground drilling in any direction. This provides further confirmation that the progressive drilling of a hole follows a maximum progressive dip angle which may incrementally change as drilling progresses, but not to the extent which exceeds the 'dogleg severity'. The 'dogleg severity' is a normalized estimate (e.g. degrees/30 metre) of the overall curvature of an actual drill-hole path between two consecutive directional survey/orientation stations.

At the surface, a remote communication device (remote communicator) 160 is set by an operator to commence a reference/start time (say, 't').

The remote communicator 160 also communicates with the core orientation device 160 and the core orientation device commences a timer/counter, say 'T'. The core orientation device 160 is then inserted into the drill hole.

Figure 2:
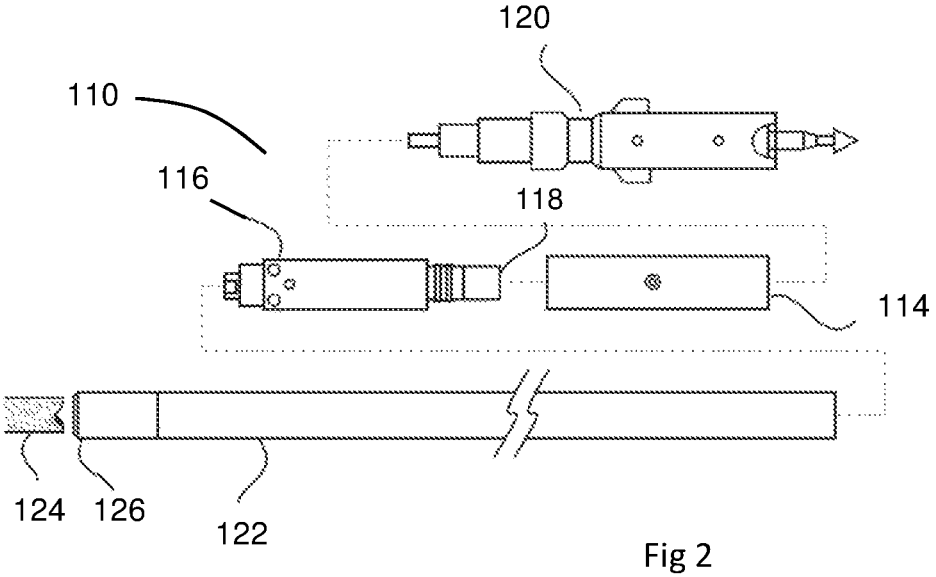
FIG. 2 shows features of a known core sample orientation system.
Figure 3:
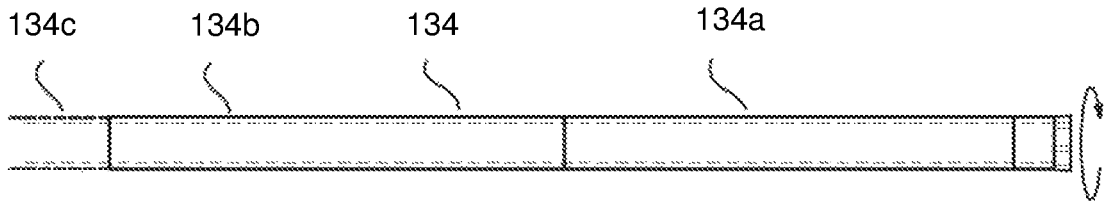
FIGS. 3 and 4 show an outer drilling tube consisting of connectable hollow steel tubes.

In FIG. 2, a known prior art inner tube assembly 110 replaces a standard greater with a two unit system 114, 116 utilising a specialised greater unit 114 and electronics unit 116 particular to the two unit system.

The electronics unit is sealed to the greater unit by o-rings, which have a tendency to fail in use and allow liquid into the electronics unit, risking loss of data and/or display failure.

The electronics unit has an LCD display 118 at one end. This allows for setting up of the system prior to deployment and to indicate visually alignment of the core sample when retrieved to the surface.

The greater unit is connected to a backend assembly 120 and the electronics unit 116 is connected to a sample tube 122 for receiving a core sample 124. The electronics unit is arranged to record orientation data every few seconds during core sampling.

The start time or reference can be synchronised with actual time using a counter or watch, such as a stop watch or other handheld timer.

Figure 4:
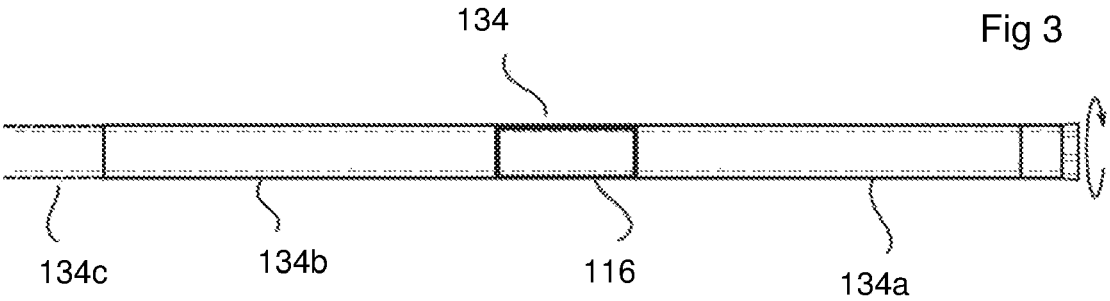

Referring to FIG. 4, the electronics unit 116 of FIG. 2 includes accelerometers 128, a memory 130, a timer 132 and the aforementioned display 118.

Figure 5:
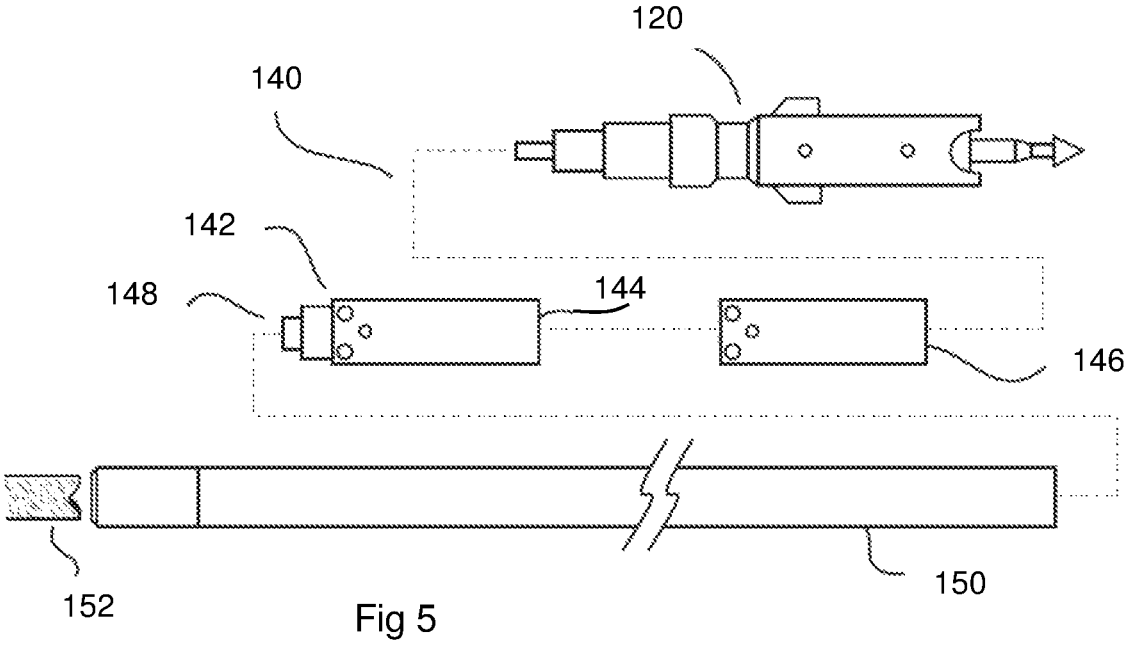
FIG. 5 shows features of an assembly including a downhole instrument, such as a core sample orientation device.

As shown in relation to FIG. 5, a system 140 according to an embodiment of the present invention is provided in relation to an outer drilling tube 134 consisting of connectable hollow steel tubes 134*a-n* has an extension piece 136 connected inline between two adjacent tubes in order to compensate the length of the outer drilling tube in relation to the additional length gained by the inner tube assembly 140 due to the core sample orientation data gathering device 142.

The core sample orientation data gathering device 142 is a fully sealed cylindrical unit with screw threads at either end. A first end 144 connects to a standard length and size greater unit 146 and a second end 148 connects to a core sample tube 150. The greater unit connects to a standard backend assembly 120.

Figure 6:
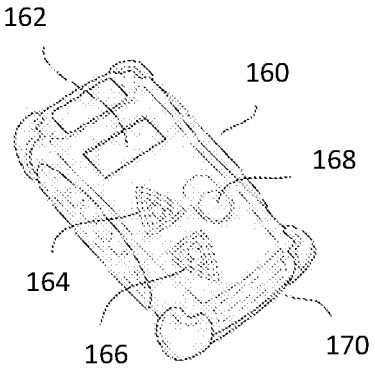
FIG. 6 shows a communication device as utilised according to an embodiment of the present invention.

FIG. 6 shows an embodiment of the hand held communication device 160 which communicates with the downhole instrument (such as the core sample orientation device) that is retrieved to the surface, receives wirelessly receives data or signals from the core sample orientation data gathering device 142.

The core sample orientation data gathering device 142 includes a transmitter which can use line of sight data transfer through the window, such as by infra red data transfer, or a wireless radio transmission.

The communication device 160 can store the signals or data received from the core sample orientation data gathering device 142. The communication device 160 includes a display 162 and navigation buttons 164, 166, and a data accept/confirmation button 168. Also, the hand held device is protected from impact or heavy use by a shock and water resistant coating or casing 170 incorporating protective corners of a rubberised material.

Setting up of the device is carried out before insertion into the drill hole. Data retrieval is carried out by infra red communication between the core sample orientation data gathering device 142 and a core orientation data receiver or communication device 160.

After recovering the core sample inner tube back at the surface, and before removing the core sample from the tube, the operator removes the 'back end assembly, and the attached greater unit. The operator then uses the remote communication device 160 to obtain orientation data from the core sample orientation data gathering device using line of sight wireless infra red communication between the remote device and the core sample orientation data gathering device.

However, it will be appreciated that communication of data between the core sample orientation data gathering device 142 and the communication device 160 may be by other wireless means, such as by radio transmission.

The whole inner tube 150, core sample 152 and core sample orientation data gathering device 142 are rotated as necessary to determine a required orientation of the core sample. The indicators on the greater end of the core sample orientation data gathering device 142 indicate to the operator which direction, clockwise or anti-clockwise, to rotate the core sample.

Preferably, one colour of indicator is used to indicate clockwise rotation and another colour to indicate anti-clockwise rotation is required. This is carried out until the core sample is orientated with its lower section at the lower end of the tube. The core sample is then marked for correct orientation and then used for analysis.

Figure 7:
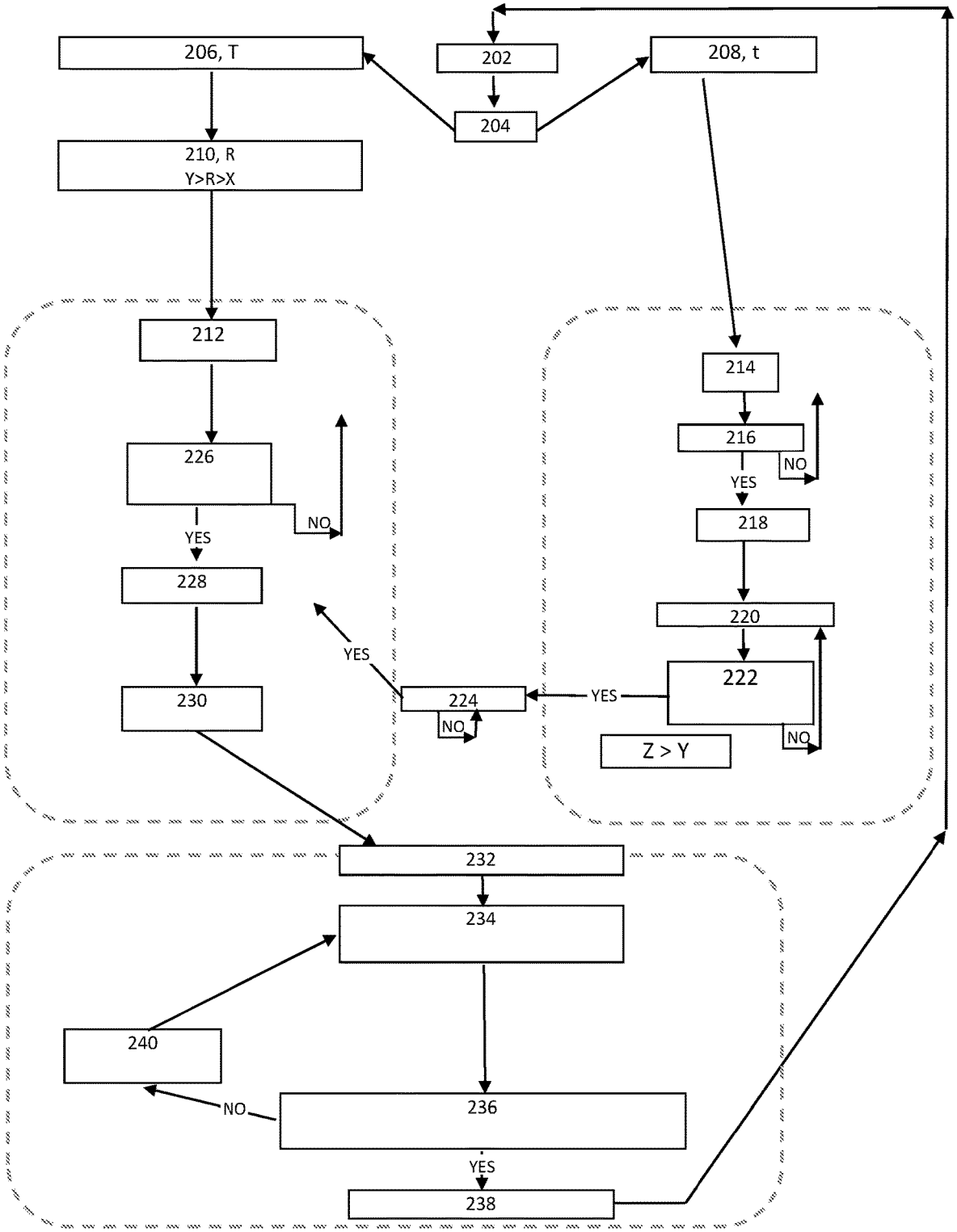
FIG. 7 shows a flowchart relating to a method and/or system according to at least one embodiment of the present invention.

FIG. 7 shows a flowchart of operational methodology and/or use of a system according to at least one embodiment of the present invention.

If a core orientation recording device 116 and a remote communicator 160 is in a standby mode 202, the respective device is 'woken up' to a start mode 204.

The core orientation recording device 116 commences a random time interval timer at time T.

The timer start at time T can be initiated by the remote communicator 160 also commencing a timer of it's own at time t. Thus, the time t of the remote communicator and time T of the core orientation recording device can be synchronised to start together.

The core orientation recording device generates a random time interval R, 210 and records 212 it's own orientation at the end of R seconds random time interval, where the random time interval is less than a maximum time interval Y and greater than a minimum time interval X i.e. Y>R>X. The orientation measurement is time stamped with accordance to the lapsed time on of the timer T.

Time t and T is progressing 214. When the core sample is ready to be broken from the subsurface material, a 'mark' is taken 216.

If the mark is taken (YES decision), the elapsed time M of the time t of the remote communicator 160 is recorded 218. If a mark is not taken (NO decision), the time t continues A period of time Z is waited 220 to ensure recordal of the next orientation of the core orientation recording device and therefore of the core. Preferably the time period Z is at least as large as the largest random time interval that might be generated i.e. Z> or =Y.

Once the time period M+Z is waited out 222, the core is then broken and the core sample, inner (core) tube and the core orientation recordal device are returned to the surface.

The remote communicator 160 is used to initiate communication 224 with the core orientation recordal device 116.

At the surface, the core orientation recording device 116 communicates 226 with the remote communicator 160. The core orientation recording device stops measuring orientation. The remote communicator transmits lapsed time M+Z to the core orientation recording device.

The remote communication device 160 identifies 230 the recorded orientation data with the largest lapsed time that has/have a time stamp between M and M+Z seconds as the correct measurement to orient the core sample.

At the surface, the core orientation recording device enters an orientation mode 232. The core orientation recording device is rotated to the original orientation when the 'Mark' was taken e.g. until a visual indication of correct orientation is given, 234.

If the core orientation recording device is orientated correctly as per original orientation when the MARK was taken, a decision 236 is made, YES/NO? If YES, 238, the remote communication device 160 confirms that the orientation of the core orientation recordal device 116 is correct i.e. a 'pass'. Identification of the correct core orientation has been found and is noted, and the core orientation recordal device and the remote communicator can go into a standby mode again. If NO, 240, the core orientation recordal device confirms that the orientation is not correct and the process of seeking the correct orientation by rotating the core orientation recordal device continues until a YES is confirmed.

The invention claimed is:

1. A method of obtaining an indication of the orientation of a core sample relative to a body of material from which the core sample has been extracted, the method comprising:

drilling a core sample from a body of material with a core drill having an inner tube;

recording measurements indicative of the orientation of the inner tube at random or non-predetermined time intervals, the measurements are time stamped and referable to an initial reference time;

recording a time beyond the reference time when the drilling has stopped and before the core sample is separated from the body of material;

separating the core sample from the body of material and retrieving the inner tube with the core sample held therein to the surface; and relating the recorded time beyond the reference time to one or more of the measurements recorded at a said random or non-predetermined time interval to obtain an indication of the orientation of the inner tube and consequently the core contained therein at the time beyond the reference time.

2. The method of claim 1, further comprising a random number generator used to generate the random or non-predetermined time intervals.

3. The method of claim 1, the random or non-predetermined time intervals within a known range between a minimum and a maximum time interval.

4. The method of claim 1, wherein recording a time beyond the reference time when the drilling has stopped is an elapsed time from the reference time plus a wait time of at least a minimum allowed random or non-predetermined time interval.

5. A method of providing an indication of the orientation of a core sample relative to a body of material from which the core sample has been extracted, the method comprising:

drilling a core sample from a body of material with a core drill having an inner tube;

recording measurements of the orientation of the inner tube at random and non-predetermined time intervals during said drilling;

the measurements are time stamped and are referable to an initial reference time;

providing a specific time beyond the reference time representative of when the drilling has stopped and before the core sample is separated from the body of material;

identifying a said measurement recorded at a said random or non-predetermined time interval indicative of the orientation of the inner tube and consequently the core contained therein at the specific time.

6. The method of claim 5, further comprising a random number generator used to generate the random or non-predetermined time intervals.

7. The method of claim 5, the random or non-predetermined time intervals within a known range between a minimum and a maximum time interval.

8. The method of claim 5, wherein recording a time beyond the reference time when the drilling has stopped is an elapsed time from the reference time plus a wait time of at least a minimum allowed random or non-predetermined time interval.

9. A method of providing an indication of the orientation of a core sample relative to a body of subsurface material from which the core sample has been extracted, the method comprising:

drilling a core sample from a body of material with a core drill having an inner tube;

recording orientation of the inner tube at random or non-predetermined time intervals subsequent to a reference time; removing the inner tube, with the core sample held therein in fixed relation to it, from the body of subsurface material; and identifying the orientation of the inner tube and core sample based on the orientation recorded at at least one of the random or predetermined time intervals based on time elapsed subsequent to the reference time.

10. A core orientation system for use with a core drill having an inner tube to receive a core sample drilled from a body of subsurface material, the system including signal producing means to produce at least one signal relating to a physical orientation of the inner tube, and time measurement means to provide a time measurement indicative of when the core sample is detached from the body of material from which it is taken and held in fixed relation to the inner tube, the time measurement based on elapsing of random and/or non-predetermined time intervals subsequent to a reference time; and input means for inputting the time measurement into the system; at least one processor for processing the at least one signal to provide data indicative of an orientation of the inner tube; and at least one processing means for processing the provided data and the inputted time measurement to produce an indication of the orientation of the core sample relative to the subsurface material from which it has been detached; and display means for the indication of the orientation of the core sample relative to the subsurface material from which it has been detached.

11. The system of claim 10, wherein the random or non-predetermined time intervals are created by a random number generator.

12. The system of claim 10, wherein the random or non-predetermined time intervals are generated to be within a range between a minimum and a maximum time interval.

13. A core orientation system for providing an indication of the orientation of a core sample relative to a body of material from which the core sample has been extracted using a core drill, the core drill having an inner tube, the system including: means for recording the orientation of the inner tube at random and/or non-predetermined time intervals during drilling by the core drill, the time intervals being referable to an initial reference time, and for inputting a specific time beyond the reference time representative of when the core sample was separated from the body of material; and means for relating the inputted specific time to the recorded random or non-predetermined time intervals to obtain an indication of the orientation of the inner tube and consequently the core contained therein at the specific time.

14. The system of claim 13, wherein the random or non-predetermined time intervals are created by a random number generator.

15. The system of claim 13, wherein the random or non-predetermined time intervals are generated to be within a range between a minimum and a maximum time interval.

* * * * *